US005979402A

United States Patent [19]

Melbourne

[11] Patent Number: 5,979,402

[45] Date of Patent: Nov. 9, 1999

[54] SPEED CONTROL FOR AN INTERNAL COMBUSTION ENGINE OF A MOTOR VEHICLE

[75] Inventor: Keith Melbourne, Leederville, Australia

[73] Assignee: Orbital Engine Company Pty Limited, Balcatta, Australia

[21] Appl. No.: 08/849,743

[22] PCT Filed: Jan. 24, 1996

[86] PCT No.: PCT/AU96/00029

§ 371 Date: Jul. 7, 1997

§ 102(e) Date: Jul. 7, 1997

[87] PCT Pub. No.: WO96/23136

PCT Pub. Date: Aug. 1, 1996

[30] Foreign Application Priority Data

Jan. 24, 1995 [AU] Australia ..... PN 0724

[51] Int. Cl.[6] ..... F02D 41/08; F02D 41/16

[52] U.S. Cl. ..... 123/339.16; 123/339.19; 123/352

[58] Field of Search ..... 123/339.16, 350, 123/352, 396, 339.19, 682, 687, 423, 422, 325; 180/179, 178; 364/431.05, 431.07; 701/105

[56] References Cited

U.S. PATENT DOCUMENTS

| | | | |
|---|---|---|---|
| 4,130,095 | 12/1978 | Bowler et al. | 123/675 |
| 4,204,483 | 5/1980 | Harada et al. | 123/339.16 |
| 4,311,123 | 1/1982 | Glockler et al. | 123/325 |
| 4,437,340 | 3/1984 | Csere et al. | 123/488 |
| 4,509,478 | 4/1985 | Ament et al. | 123/339.21 |
| 4,619,232 | 10/1986 | Morris | 123/339.11 |
| 4,819,596 | 4/1989 | Yasuoka et al. | 123/339.16 |
| 4,877,002 | 10/1989 | Shimomura et al. | 123/339 |
| 5,031,594 | 7/1991 | Morikawa | 123/295 |
| 5,113,820 | 5/1992 | Flaig | 123/325 |
| 5,163,398 | 11/1992 | Buslepp et al. | 123/339.22 |
| 5,218,939 | 6/1993 | Stumpp | 123/339 |
| 5,540,205 | 7/1996 | Davis et al. | 123/486 |
| 5,606,951 | 3/1997 | Southern et al. | 123/339 |
| 5,628,290 | 5/1997 | Iida et al. | 123/339.12 |
| 5,668,727 | 9/1997 | Pellerito et al. | 701/105 |
| 5,720,258 | 2/1998 | Tolkacz et al. | 123/339.15 |
| 5,863,277 | 1/1999 | Melbourne | 123/339.19 |
| 5,901,682 | 5/1999 | McGee et al. | 123/339.19 |

OTHER PUBLICATIONS

The Motor Vehicle, Twelfth Edition, Newton et al, 1996, pp. 329–385.

*Primary Examiner*—Willis R. Wolfe
*Assistant Examiner*—Hieu T. Vo
*Attorney, Agent, or Firm*—Nikaido, Marmelstein, Murray & Oram, LLP

[57] ABSTRACT

A control system for controlling the speed of an internal combustion engine of a motor vehicle wherein the control system provides open loop control of the fueling rate of the engine whereby the engine fuelling rate is controlled as a function of the engine speed when the engine is free of any operator demand thereon and when the motor vehicle is moving above a predetermined vehicle speed.

24 Claims, 3 Drawing Sheets

SPEED CONTROL FOR AN INTERNAL COMBUSTION ENGINE OF A MOTOR VEHICLE

This invention relates generally to the control of an internal combustion engine of a motor vehicle including motorcars, trucks, motorcycles, scooters, snowmobiles and all-terrain-vehicles, and in particular to the control of the idle speed of the engine. The invention is applicable for motor vehicles having either a manual or an automatic transmission, and for both two stroke or four stroke internal combustion engines.

The term "idle speed" refers to the engine speed when there is no operator initiated demand on the engine which may relate to, for example, when the vehicle is stationary or when the vehicle is freewheeling down a hill.

BACKGROUND OF THE INVENTION

It is known to use electronic engine management systems for controlling the operation of an engine within a motor vehicle. It is also known to have a control system for performing "closed loop idle control" to control the idle speed of the engine. This is a control strategy whereby, typically, the actual idle speed of the engine is compared to a desired target value idle speed at regular intervals. The engine idle speed is returned or adjusted to that target value when any deviation from that target value occurs.

In conventional homogeneous charge internal combustion engines, the engine speed and the idle speed in particular are typically controlled by a throttle valve controlling air flow to the engine. In such an engine, the control system will normally define idle as being when the throttle is closed. In contrast, in the case of engines such as the Applicant's stratified charge, air assisted, fuel injected engine, the engine speed is increased or decreased at idle by respectively increasing or decreasing the fuelling rate when under closed loop idle control. Accordingly, in such an engine, the control system may preferably define idle as being when the accelerator pedal of the vehicle is fully disengaged. Typically, the fuelling rate is controlled by varying the opening time, commonly known as the "pulse" time, of the fuel injectors and therefore changing the amount of fuel injected into the cylinders of the engine. The fuel based control system of the Applicant's engine therefore uses the fuelling rate as the primary control parameter and the required air flow is determined as a function of the fuelling rate. Although a throttle valve can and typically will be used to control the air flow to the engine, the throttle valve does not regulate the engine speed as in conventional engines.

In either of these engine applications, idle speed control may occur both when the motor vehicle is stationary and when the motor vehicle is in motion. However, if the control system performs closed loop idle control when the motor vehicle is in motion, significant "driveability problems" associated with the phenomenon commonly referred to as "tip-in/tip-out" can result. This phenomenon can manifest physically as rocking of the engine relative to the motor vehicle chassis during acceleration, such as the throttle opening from idle (tip-in), or deceleration, such as throttle closure to idle (tip-out).

Tip-out problems occur due to the engine being driven through the gearbox during vehicle motion whilst there is no operator demand on the engine, for example, such as when the throttle is closed. In the case of fuelling controlled engines, this tends to maintain the engine speed irrespective of any attempt to control it by fuelling reduction.

Accordingly, the closed loop idle control system, sensing this maintained engine speed, typically reduces the fuelling to the engine significantly or totally in an attempt to reduce the engine speed to the target idle speed value. This generally causes a severe vehicle deceleration through the motor vehicle drive-line, which may typically be compounded by induced engine rocking. This is a very undesirable condition which makes the motor vehicle very difficult to drive smoothly.

Tip-in problems in fuelling controlled engines occur partly due to the fuelling rate being significantly reduced (due to closed loop idle) during tip-out as described above. As mentioned, this induces significant motor vehicle deceleration and engine rocking in the forward direction (in a transverse engine configuration) due to motoring through the gearbox. With regard to tip-in, the main problem arises in that, when the operator demand is once again applied, for example, such as the throttle being re-opened, the fuelling level has to be increased very rapidly to get from a significantly low level to the desired level for a drive away or acceleration condition, or too much lag will be felt in the engine response. This however causes a very rapid change in engine torque. This typically results in a reaction force causing the engine to rock rearwards (in a transverse engine configuration) with significant force resulting in a shock through the engine mounts and hence the motor vehicle.

Tip-in problems are compounded further on a motor vehicle having an automatic transmission due to the desired low engine idle speed when there is no operator demand, such as when the motor vehicle is stationary, in order to reduce the torque converter load and to avoid wasting fuel. When a tip-in occurs from such a low idle speed and the change in the fuelling rate is very rapid, the engine speed begins to increase. However, from such a low idle speed, the engine speed has to increase significantly before torque is transferred through the torque converter (or the "stall speed" thereof is reached) thus causing a time delay in response to operator or driver demand for acceleration. As the engine speed increases, the rotating components thereof gather momentum and when decelerated by the torque converter, the energy acquired due to this increasing momentum is dissipated as a severe shock through the motor vehicle drive-line. This is very undesirable and makes the motor vehicle difficult to drive smoothly.

The motor vehicle drive-line will typically include those components that transmit the rotating energy of the engine to the driving wheels of the vehicle. In a vehicle with a transverse engine configuration, the drive-line will include the engine gearbox or transmission whilst in conventional vehicles with rear wheel drive, the drive-line will also include for example the drive-shaft and the differential.

It is to be noted that these problems are potentially more pronounced in the Applicant's engine which typically runs in a highly stratified mode (ie: has excess air). The fuelling rate of the engine may be increased very rapidly (ie: can be increased as such in one cycle) in response to rapid changes in engine load demand and hence engine torque can rise very rapidly. Accordingly, there is a need for an alternative means of controlling the engine idle speed during vehicle motion so as to improve the tip-in and tip-out feel of the motor vehicle.

It is therefore an object of the present invention to provide improved control of the idle speed of an internal combustion engine which at least substantially avoids one or more of the above noted problems.

SUMMARY OF THE INVENTION

With this in mind, the present invention provides in one aspect a method of controlling the speed of an internal combustion engine of a motor vehicle comprising providing open loop control of the fuelling rate of the engine wherein the fuelling rate to the engine is modified when the engine is free of any operator derived load demand and when the engine is drive coupled to the vehicle wheels.

According to another aspect of the present invention, there is provided a control system for controlling the speed of an internal combustion engine of a motor vehicle wherein the control system provides open loop control of the fuelling rate to the engine when the engine is free of any operator derived load demand and when the engine is drive coupled to the vehicle wheels.

Conveniently, a neutral response means may be provided to determine when the engine is not drive coupled to the vehicle wheels indicating that open loop control is not required. Such a neutral response means would indicate when the vehicle transmission is out of gear and could be implemented on a manual or automatic transmission.

Conveniently, where the vehicle is fitted with a driver operated or manual transmission between the engine and the wheels, a response means, such as a clutch switch, may be used to indicate when the engine is drive coupled to the vehicle wheels. It is however to be noted that other response means for establishing or indicating whether the engine is drive coupled to the vehicle wheels may be used such as a switch actuated when the drive train is in neutral.

Preferably the engine fuelling rate is controlled as a function of the engine speed and/or vehicle speed when the vehicle is moving above a predetermined vehicle speed.

Preferably, under open loop control, the engine fuelling rate is controlled as a function of the engine or vehicle speed with either of these being allowed to vary in response to engine operating conditions. This is different from closed loop control where the engine fuelling rate is controlled to maintain or return the engine speed to a target value.

The engine is said to be drive coupled to the vehicle wheels when the rotating components of the engine are doing work or are coupled to do work to drive or turn the driving wheels of the vehicle. For example, in a vehicle having a manual transmission, the engine would be said to be drive coupled to the vehicle wheels, or connected to the vehicle drive-line, when a gear is engaged and the engine clutch is engaged. Hence, if the vehicle operator depresses the clutch pedal to disengage the clutch, the engine would not be drive coupled to the vehicle wheels. Equally, if the operator selects a neutral gear, the engine would not be drive coupled to the vehicle wheels.

In a vehicle having an automatic transmission, the engine would be said to be drive coupled to the vehicle wheels when a forward or reverse gear is selected and when torque is being transferred to the torque converter. Importantly, the engine would not be drive coupled to the vehicle wheels if the engine speed was below the stall speed of the torque converter. Such a situation would equate to the engine idling whilst "in-gear" and no torque being transferred through the torque converter to drive or turn the driving wheels of the vehicle. Obviously, neutral being selected would also correspond to the engine not being drive coupled to the vehicle wheels.

It has been found that if the engine speed is controlled by way of an open loop control system which controls the engine fuelling rate, the engine speed can settle to a particular value whereby there is a balance between the engine braking torque and the motoring torque applied through the transmission, such as the gearbox, and drive-line of the motor vehicle. This results in a significant reduction or elimination of undesirable tip-in and tip-out effects.

Preferably, open loop control of the fuelling rate of the engine is arranged to control the idle speed of the engine, particularly when the vehicle is moving.

Preferably, the open loop engine fuelling rate may be profiled such that a particular fuelling rate is provided for a particular engine speed and/or vehicle road speed independent of other factors. It is to be noted that, particularly in relation to four stroke cycle engine applications, the fuelling rate at idle is dependent upon air flow into the engine. Typically, the air flow is controlled by an idle speed control valve. Accordingly, in such an application to achieve a fuelling profile the control valve position could be profiled against engine speed.

The profiling of the open loop control fuelling rate against engine and/or road speed may be such that the engine fuelling rate decreases with increasing speed and increases with decreasing speed. The lowering of the fuelling rate as the engine and/or road speed increases results in a reduction in the engine output torque. Thereby, when the vehicle operator closes the throttle or removes the load demand from the engine at high engine/vehicle speeds, the motor vehicle induced motoring torque transferred through the vehicle drive-line to the engine is greater than the engine output torque. This results in a braking/vehicle deceleration effect. As the vehicle/engine speed decreases and the engine fuelling rate increases, the engine output torque continues to increase until it is in balance with the vehicle induced motoring torque, whereafter the vehicle/engine ceases to decelerate. This avoids "hanging up" of the vehicle/engine speed, (ie: the vehicle/engine speed being maintained at a level higher than is desired) and prevents severe deceleration which would result in the tip-out effects, as previously discussed, and hence improves motor vehicle drivability.

To provide more accurate control of the engine fuelling rate as a function of the engine speed, the control system may include at least one open loop fuelling map, for controlling the fuelling rate as a function of the engine speed when the control system is operating under open loop idle. The open loop map may be obtained by experimental tests to determine the optimum fuelling rates for different road speeds of a motor vehicle which minimise tip-in/tip-out effects.

It may be convenient to also regulate the fuelling rate during open loop idle as a function of the particular gear ratio that has been selected from the range available in the gearbox of the vehicle. To this end, separate open loop fuelling maps may be provided for selection dependent on the selected gear ratio of the vehicle transmission. Open loop fuelling maps may be provided for some or all of the selectable gear ratios available. This would further enhance the open loop idle control as the degree of motoring torque or load transferred from the gearbox to the engine is significantly changed by the gear ratio selected. Therefore the fuelling rate and engine speed will settle to different values in dependence on the selected gear ratio and the control achieved would be less compromised than if a single open loop fuelling map were used for all of the various gear ratios available in the vehicle gearbox.

The control system may also be sophisticated enough to apply fuelling offsets to the or each open loop fuelling map to take account of any parasitic loads which may be applied to the engine, such as from an air-conditioning compressor. In this way, the delivered fuelling rates as a function of engine speed will ensure that the same engine output torque, as would be expected when no such parasitic load was applied to the engine, would be maintained. Accordingly, the same vehicle/engine speed deceleration rates can be maintained.

The control system may further include filter means to filter the fuelling rates of the open loop fuelling maps once open loop control has been established and in the event that fuelling rates differ significantly from the fuelling rates being delivered just before the control system enters open loop control. In this way, rapid increases or decreases in the mapped fuelling rates, due to the application of the open loop fuelling map or maps, as profiled against engine speed can be prevented. Such rapid increases or decreases in the fuelling rate are undesirable as they may cause "shunt" in the vehicle drive-line.

The control system may also provide closed loop control of the engine speed when there is no operator demand and the engine is disconnected from the vehicle drive-line, wherein a target idle speed is predetermined, and wherein the control system varies the fuelling rate to the engine to maintain the actual engine idle speed at least substantially at the target idle speed. Preferably, the control system provides closed loop control of the engine speed when the motor vehicle is moving below the predetermined speed or is stationary.

The problems associated with tip-in/tip-out are at least substantially avoided by the present invention which typically allows the engine speed to settle to a level dependent on the balance of torques in the system whilst there is no driver or operator demand during vehicle motion (ie: idle at a higher engine speed than would otherwise be the case) and which also or alternatively, does not reduce the fuelling rate to the engine if the engine is being driven through the gearbox as is typically the case under normal closed loop control whilst the motor vehicle is in motion and there is no driver demand.

The invention will be more clearly understood from the following description made with reference to the accompanying drawings.

DETAILED DESCRIPTION OF THE INVENTION

Figure 1:
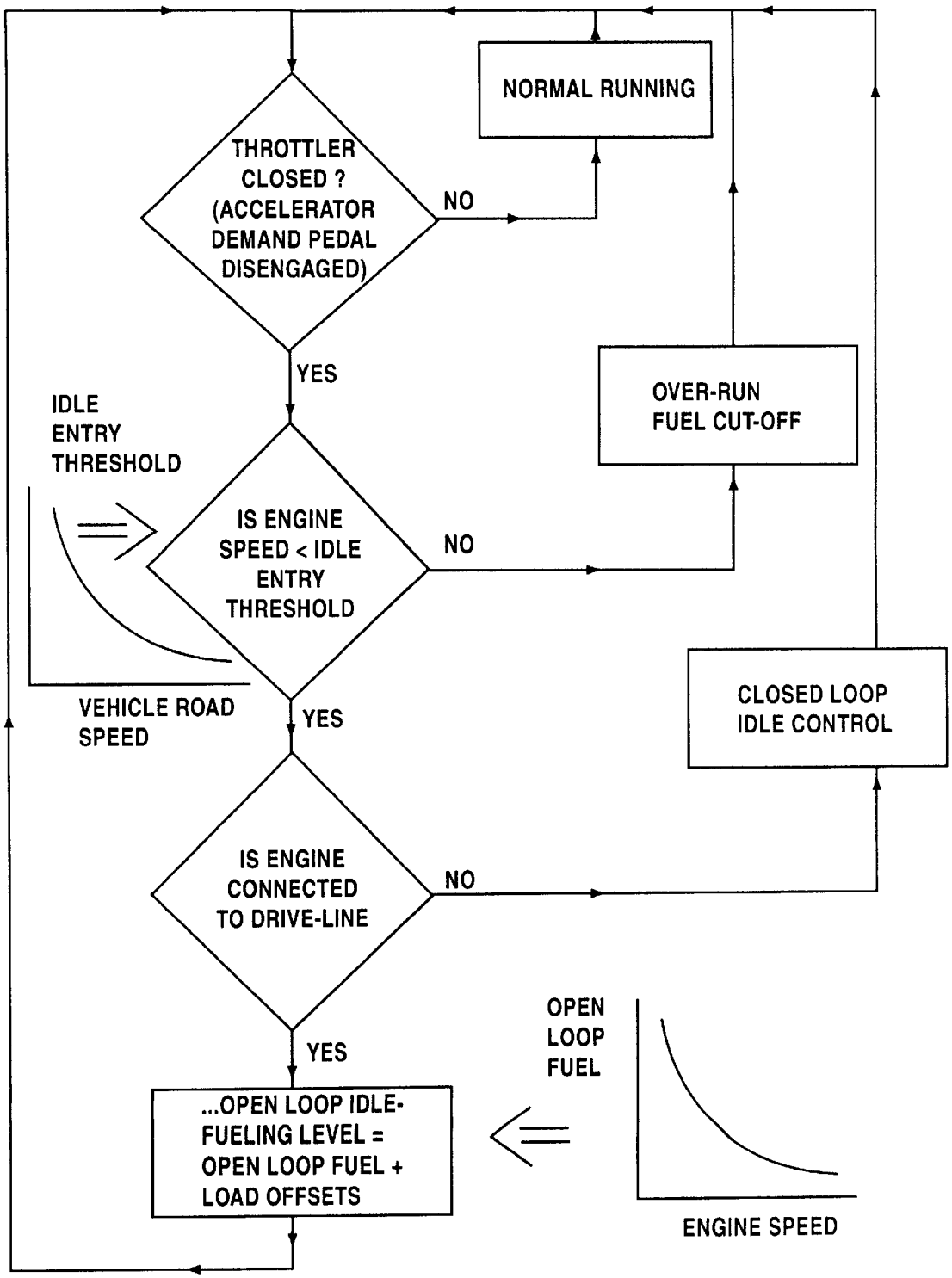
FIG. 1 is a flowchart showing the operation of the control system according to the present invention.

Referring initially to FIG. 1, the flowchart shows the operation of the control system during periods of idle when there is no driver demand on the engine. The control unit 1 periodically checks whether the accelerator pedal 2 controlling the engine fuelling rate is disengaged which indicates when the engine is in an idling or no load mode of operation. If the accelerator or demand pedal is engaged or depressed, then the control system maintains its normal engine management control for the engine when under load. As previously alluded to hereinbefore and particularly in the case of four stroke engines, the control system may alternatively periodically check whether the throttle controlling the air to the engine is closed which would similarly indicate that the engine is in an idling or no load mode of operation. Further, it is to be noted that the control system is not limited to controlling the engine idle speed and can be implemented to control the off-idle engine speed as well.

If the accelerator pedal is disengaged by the driver or operator of the vehicle, the control system then checks an engine speed sensor 3 to determine whether the engine speed is less than the idle entry threshold. This engine speed can be determined by experimentation and may be profiled against vehicle road speed as discussed briefly hereinafter. In this regard, the idle entry threshold may be higher for lower vehicle road speeds and lower for higher vehicle road speeds. If the engine speed is not less than the idle entry threshold, the control system switches to over-run fuel cut-off mode wherein fuelling to the engine is ceased in the known manner.

If the engine speed is less than the idle entry threshold, the control system then enters an idle mode of operation. In the embodiment as described, the control system checks to see whether the engine is connected to the vehicle drive-line. As alluded to hereinbefore, depending on the nature of the vehicle transmission, a clutch switch 4 and/or a neutral switch may be used to determine this. Alternatively, such a determination may be made from the vehicle road speed.

If the engine is not connected to the drive-line, the control system switches to closed loop idle control. In a vehicle with a manual transmission, this would equate to the situation where, for example, the clutch was disengaged and the engine 5 was not causing the gearbox 6 and hence the driving wheels to turn. In a vehicle having an automatic transmission, this would equate to the situation where the transmission was in neutral. Under this closed loop idle control, the actual idle speed of the engine is periodically compared with a desired target value and returned to that target value when any deviation occurs.

In the case where the vehicle's road speed is used to determine whether to enter closed loop idle control, this method being particularly applicable to vehicles having an automatic transmission, the control system may check whether the motor vehicle's road speed is greater than a predetermined road speed. This closed loop entry road speed can typically be within the range from 1 km/hr to 10 km/hr, although it is to be appreciated that the predetermined speed will vary depending on the engine performance characteristics and other parameters. Accordingly, the control system switches to closed loop idle control if the motor vehicle speed is less than this closed loop entry speed.

Such control of the engine idle speed is acceptable when the motor vehicle is at rest because the tip-in/tip-out effects as mentioned hereinbefore are not relevant at such instances. However, when the motor vehicle is in motion, tip-in/tip-out can become a problem and a different form of engine idle speed control is required to minimise or prevent such effects. Therefore, when the engine is connected to the drive-line, the control system switches to open loop idle control. The control system remains in this mode of operation until the motor vehicle speed drops below the closed loop entry speed or the accelerator is depressed or engaged.

The previously mentioned clutch and/or neutral switches may again be used to provide the determination that the engine is connected to the drive-line. In a vehicle having a manual transmission, this would equate to the clutch being engaged and the transmission being in-gear. In a vehicle having an automatic transmission, this would equate to the transmission being in-gear (ie: not in neutral) and the engine speed being greater than the stall speed of the torque converter such that torque generated by the engine is being transferred to the gearbox and hence drive-line of the vehicle. In the case where vehicle road speed is used to determine whether to switch to open loop idle control, this would equate to the motor vehicle speed being above the closed loop entry road speed.

Figure 2:
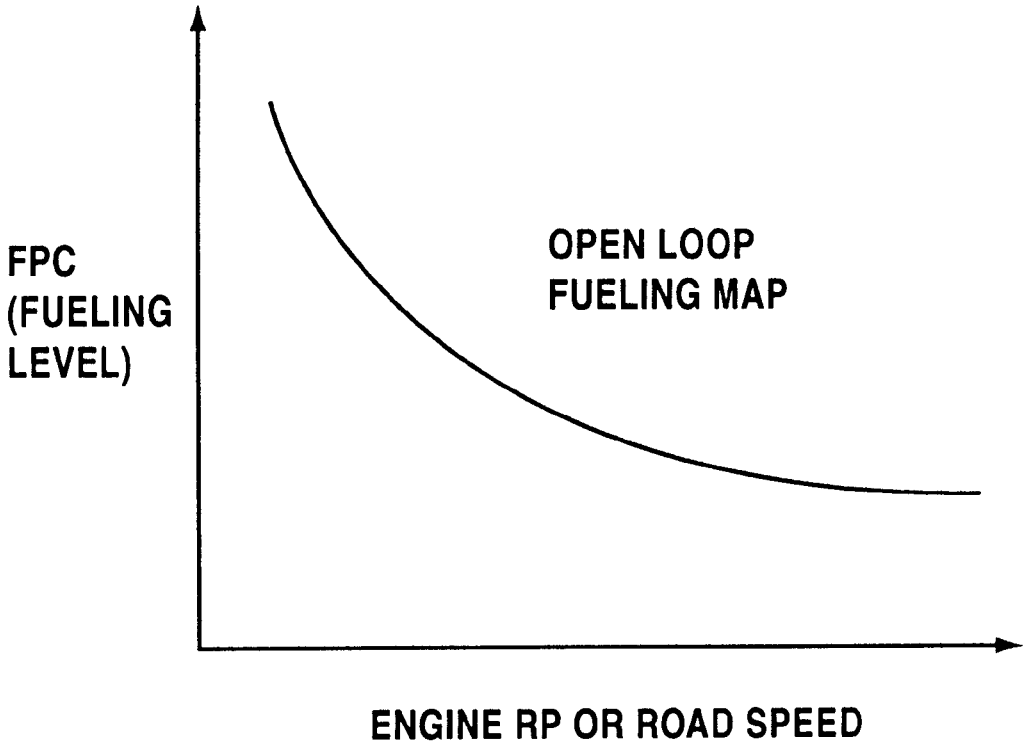
FIG. 2 is a diagram showing the relationship between the fuelling rate (FPC) and the engine speed (RPM) or vehicle speed when the control system is providing open loop control.
Figure 3:
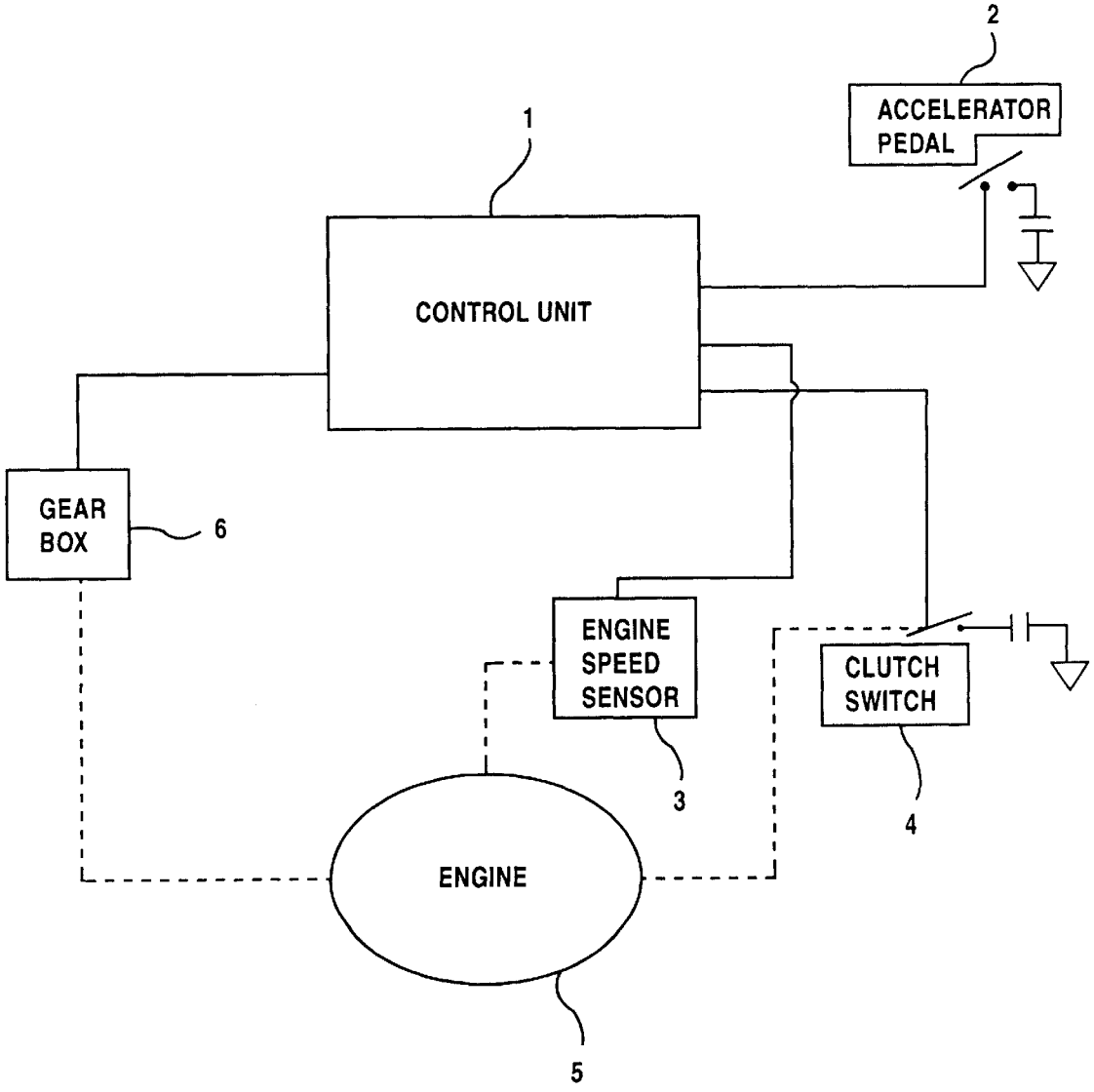
FIG. 3 is a diagram showing the relationship of the control unit to other elements of the control system.

In the Applicant's engine, commonly known as the OCP engine, the engine fuelling rate normally directly controls the engine output torque and the resultant engine speed. The engine fuelling rate is controlled as a function of the engine speed or road speed during open loop control of the engine. The control system can use an "open loop fuelling map" based on the characteristic as shown in FIG. 2 which provides a fuelling rate as a function of the engine speed or road speed. In the flowchart of FIG. 1, engine speed has been used.

At lower engine speeds, the fuelling rate is higher providing higher engine torque. Therefore tip-in problems arising as the motor vehicle is accelerated and hence the speed of the engine is caused to accelerate are minimised because the rate or level of increase of the engine torque is reduced thereby reducing the shock through the drive-line of the motor vehicle. At higher engine speeds, the fuelling rate is arranged to be lower than at the lower engine speeds. This results in an overall lower engine torque which increases engine braking and gradually decelerates the motor vehicle and prevents any "hang-up" of the engine speed.

The control system may also take into account any parasitic loads that may be applied to the engine when it switches to or is running open loop idle control. In this regard, offsets may be applied to the open loop fuelling map to ensure that a certain engine output torque is maintained for a particular engine speed when, for example, an air-conditioning compressor is applying a load on the engine.

Further, the control system may apply a filter means to the calculated open loop fuelling levels to dampen out any rapid increases or decreases in the fuelling levels to the engine. In this way, "shunt" in the vehicle drive-line can be prevented and hence good vehicle drivability can be maintained.

The degree of motoring torque applied to the engine through the gearbox varies significantly with changes in gear ratio. Separate open loop fuelling maps can therefore be provided, one for each or some of the gears of the engine gearbox. This further enhances the operation of the control system during open loop control. It is of course possible to use only a single open-loop fuelling map, the fuelling profile of the map being a compromise between the various gears. Such gear dependent open loop fuelling maps would also enable a lower fuelling rate and hence idle engine speed to be selected for higher gears were tip-in and tip-out are not so severely affected by the lower engine speed and shocks through the motor vehicle drive-line are not so severe.

As alluded to hereinbefore, it is also possible to profile the threshold engine speed for engine over-run fuel cut-off situations as road speed changes. At low vehicle road speeds, higher threshold engine speeds are required as tip-in and tip-out effects are more significant. Such higher threshold engine speeds will provide better drivability. At high vehicle road speeds, vehicle inertia results in any tip-in or tip-out effects being less significant and so lower threshold engine speeds for engine over-run fuel cut-off situations may be used. Accordingly, in this latter regard significant fuel economy benefits may be obtained and good drivability maintained by lowering the threshold engine speeds as vehicle road speed increases.

Although the method is generally described in relation to the OCP engine, it is to be appreciated that the control strategy is also applicable to other internal combustion engines including four stroke engines. Further, although the method is generally described in relation to the engine fuelling rate being controlled as a function of engine speed, road speed may equally be used.

I claim:

1. A control system for controlling the speed of an internal combustion engine of a motor vehicle wherein the control system provides open loop control of the fuelling rate to the engine when the engine is free of any operator derived load demand and when the engine is drive coupled to the vehicle wheels.

2. A control system according to claim 1, wherein the control system includes at least one open loop fuelling map for controlling the fuelling rate as a function of the engine speed.

3. A control system according to claim 2, wherein the open loop fuelling map decreases the engine fuelling rate with increasing engine speed and increases the engine fuelling rate with decreasing engine speed.

4. A control system according to claim 2, wherein the motor vehicle includes a gearbox and the control system includes a plurality of open loop fuelling maps, the control system selecting a said map as a function of a selected gear of the gearbox.

5. A control system as claimed in claim 2 wherein a fuelling offset or offsets are provided for at least one of said maps to compensate for a parasitic load or loads on the engine.

6. A control system according to claim 1 wherein the open loop control of the fuelling rate is a function of speed.

7. A control system according to claim 1 wherein the open loop control of the fuelling rate is a function of road speed.

8. A control system according to claim 1, wherein the control system further provides closed loop control of the engine fuelling rate whereby the fuelling rate is controlled to maintain a target engine speed when the motor vehicle is moving below a predetermined speed.

9. A control system as claimed in claim 1 wherein the control of the fuelling rate is only effected when the vehicle is travelling at a speed above a predetermined speed.

10. A control system as claimed in claim 1 wherein means responsive to the absence of a drive connection between the engine and the vehicle wheels is provided to inhibit establishment of the open loop control of the fuelling rate when no drive connection exists.

11. A control system as claimed in claim 10 wherein said responsive means respond to de-coupling of a gear train between the engine and the vehicle wheels.

12. A method of controlling the speed of an internal combustion engine of a motor vehicle including:

a) determining whether the engine is free of any operator demand;

b) determining whether the engine is connected to the vehicle drive line;

c) providing open loop control of the fuelling rate of the engine when the engine is free of any operator load demand and the engine is connected to the vehicle drive line;

d) providing closed loop control of the fuelling rate of the engine when the engine is free of any operator demand and the vehicle engine is not connected to the vehicle drive line; and e) providing normal control of the engine fuelling rate when there is an operator demand on the engine.

13. A method according to claim 12, wherein the engine is free of operator demand when an accelerator pedal of the vehicle is disengaged.

14. A method according to claim 12, wherein the engine is free of operator demand when an inlet air throttle valve of the vehicle is closed.

15. A method of controlling the speed of an internal combustion engine of a motor vehicle comprising providing open loop control of the fueling rate of the engine wherein the fuelling rate to the engine is modified when the engine is free of any operator derived load demand and when the engine is drive coupled to the vehicle wheels.

16. A method as claimed in claim 15 wherein the fueling rate is controlled to promote maintenance of a selected engine speed.

17. A method as claimed in claim 15 wherein said control of the fueling rate is only effected when the vehicle is travelling at a speed above a predetermined vehicle speed.

18. A method as claimed in claim 15 wherein the open loop control of the fueling rate is controlled as a function of engine speed.

19. A method as claimed in claim 15 wherein the open loop control of the fueling rate is controlled as a function of vehicle road speed.

20. A method as claimed in claim 15 wherein the fueling rate is controlled to establish and/or control the engine speed to a target speed when the vehicle is travelling below a preselected speed.

21. A method as claimed in claim 15 wherein the open loop control of the fueling rate of the engine is arranged to control the idle speed of the engine.

22. A method as claimed in claim 15 claims wherein the fuelling rate to the engine is modified by the application of a fueling offset to account for a parasitic load on the engine.

23. A method according to claim 15, including decreasing the engine fuelling rate with increasing engine speed and increasing the engine fuelling rate with decreasing engine speed under open loop control of the engine.

24. A method according to claim 15, including further controlling the engine fueling rate as a function of a selected gear of the engine under open loop control.

* * * * *